US007188574B2

(12) United States Patent
Converse et al.

(10) Patent No.: US 7,188,574 B2
(45) Date of Patent: Mar. 13, 2007

(54) CYLINDRICAL HULL STRUCTURAL ARRANGEMENT

(75) Inventors: Robin M. Converse, Houston, TX (US); Young-Chan Park, Houston, TX (US)

(73) Assignee: SparTEC, Inc., Houston, TX (US)

( * ) Notice: Subject to any disclaimer, the term of this patent is extended or adjusted under 35 U.S.C. 154(b) by 0 days.

(21) Appl. No.: 11/214,069

(22) Filed: Aug. 29, 2005

(65) Prior Publication Data

US 2006/0185573 A1 Aug. 24, 2006

Related U.S. Application Data

(60) Provisional application No. 60/654,994, filed on Feb. 22, 2005.

(51) Int. Cl.
*B63B 1/00* (2006.01)
*E02D 23/00* (2006.01)

(52) U.S. Cl. ..... 114/59; 405/195.1

(58) Field of Classification Search ..... None
See application file for complete search history.

(56) References Cited

U.S. PATENT DOCUMENTS 1,303,689 A * 5/1919 Leparmentier ..... 114/61.3
3,434,442 A * 3/1969 Manning ..... 114/256
4,656,959 A * 4/1987 Moisdon ..... 114/56.1
4,702,321 A * 10/1987 Horton ..... 166/350
5,558,467 A * 9/1996 Horton ..... 405/195.1
6,161,620 A * 12/2000 Cox et al. ..... 166/367
6,244,785 B1 * 6/2001 Richter et al. ..... 405/195.1
6,575,665 B2 * 6/2003 Richter et al. ..... 405/195.1

* cited by examiner

*Primary Examiner*—Jesus Sotelo
*Assistant Examiner*—Daniel V. Venne
(74) *Attorney, Agent, or Firm*—D. Neil LaHaye; Eric Marich

(57) ABSTRACT

An improved floating circular hull construction arrangement. The hull is divided into sections by watertight flats. The flats are stiffened with angles or bulb tees curved to form concentric circles that are in turn supported by the radial girders spaced around the flats and spanning between the inner and outer-shells. In each section, longitudinal girders spaced radially around the inside of the outer-shell terminate at the flats and attach to the flats and do not penetrate the flats. The longitudinal girders are attached to flats aligned with the locations of the radial girders that extend across the flats to the inner and outer shells. A panel stiffening arrangement on the inner circumference of the outer shell is attached to the outer shell and the longitudinal girders. Longitudinal girders spaced around the outer circumference of the inner shell extend along the length of the inner shell and are attached to the radial girders. With the inner and outer longitudinal girders connected to the radial girders, moment resisting frames are created that are arranged radially in each compartment. These frames stiffen the individual girders as well as balance the differential axial loadings in the inner shell and outer shell surfaces. The compartments are assembled with the sections in a vertical orientation to minimize self-weight distortion during erection and to provide direct access with shop cranes during assembly of the full sections. The completed sections are rotated to the horizontal to be joined to the other sections to form a complete cylinder.

10 Claims, 11 Drawing Sheets

CYLINDRICAL HULL STRUCTURAL ARRANGEMENT

RELATED APPLICATIONS

This application references and claims the benefit of Provisional Application Ser. No. 60/654,994 filed on Feb. 22, 2005.

FIELD AND BACKGROUND OF INVENTION

The invention is generally related to floating offshore structures and more particularly to cylindrical hulls or cylindrical sections of hulls.

The offshore oil and gas industry utilizes various forms of floating systems to provide "platforms" from which to drill for and produce hydrocarbons in water depths for which fixed platforms, jack-up rigs, and other bottom-founded systems are comparatively less economical or not technically feasible. The most common floating systems used for these purposes are Spar Platforms (Spars), Tension Leg Platforms (TLPs), Semi-Submersible Platforms (Semis), and traditional ship forms (Ships). All of these systems use some form of stiffened plate construction to create their hulls. The present invention generally applies to those systems, or portions of those systems, in which the stiffened plate section is cylindrical, in the broad sense of the term. Additional aspects of the invention apply particularly to cylindrical hulls that are circular in cross section. Circular cylindrical hulls are most commonly characteristic of Spars, Mono-column TLPs, and legs (columns) of Semis.

In the prior art, the structural arrangements and methods of assembly are based on ship design practices developed over many years. In these systems, the shell plate or structural skin is first stiffened in the longitudinal direction of the cylinder, usually with smaller elements such as structural angles or bulb tees. This plate, stiffened in one direction, is then formed into a full cylinder or a section of a cylinder with these stiffeners parallel to the centerline of the cylinder. Whether the form is curved or flat-sided, the shape of the cylinder is locked in place using girders or frames oriented transversely to these longitudinal stiffeners. These frames are located at relatively uniform intervals in order to limit the spans of the stiffeners to acceptable distances. The spans of these girders and frames themselves may be shortened using intermediate supports, as determined by the designer, in order to optimize the design by choosing to fabricate the extra supports instead of fabricating larger girders or frames for longer spans.

The spacing of the longitudinal stiffeners is based on 1) a minimum distance required for access between the stiffeners for welding to the shell plate (approximately 22 to 26 inches) and 2) a balance between shell plate thickness and stiffener spacing for the plate-buckling checks. The frames or girders transverse to the stiffeners are spaced at least four feet apart for in-service inspection access and up to eight feet depending upon how the design engineer elects to balance the stiffener sizing with the girder spacing.

Like all floating systems, cylindrical hulls are divided into watertight compartments in order to accommodate specified amounts of damage (flooding) without sinking or capsizing.

With the exception of a specialized version of the Spar concept that uses a grouping of smaller diameter, circular cylinders to create much of its compartmentation, the sections of the cylindrical hulls are divided into compartments by watertight flats and bulkheads. These terms may have somewhat different meanings in Spar hulls since these hulls have cylinders that float vertically in service compared to ship hulls that float horizontally. In Spars, TLPs, and other deep-draft columned hulls, the flats are perpendicular to the longitudinal stiffeners and the bulkheads are parallel to these stiffeners, while in ships they are the opposite. The descriptions herein will use the terms as applied to Spars and other vessels with vertically oriented cylindrical sections.

Carried over from ship design practices of the prior art, the longitudinal stiffeners are made structurally continuous through, or across, the flats so the stiffeners can be considered to act together structurally with the shell plate when computing the total bending capacity for the cylinder. This is accomplished either by making the stiffeners pass continuously through the flats or by stopping the stiffeners short of the flats and adding brackets on either side that replace the structural continuity that was lost in stopping the stiffeners. When the stiffeners pass through a flat, the holes in the flat have to be closed up to maintain the flat's watertight integrity. When the stiffeners do not pass through the flat, a great number of brackets must be added and these brackets must align axially across the flat. Both approaches are very labor intensive and thus very costly.

In ships, where the design is largely controlled by loadings from longitudinal bending rather than from hydrostatics, this continuity of the stiffeners over the length of the shell plate is structurally warranted. In 1) vertically oriented, single cylinder hulls, 2) in multi-leg TLPs and 3) Semis with columns and pontoons submerged quite deep compared to ship drafts, loadings from hydrostatics, instead of loading from longitudinal bending, control much of the sizing of the hull structure. For these floating systems, the structural continuity of the stiffeners, which is so valuable in ship design, is not particularly valuable in non-ship-type hulls. However, in the prior art, this fundamental difference in loadings has not been reflected in the design of the Spar and similar cylindrical hulls.

FIGS. 1 and 2 illustrate cross sections of a prior art, cylindrical, Spar hull construction arrangement. A flat-sided, flooded center well 100 that is square or rectangular in shape is provided to accommodate a regular array of risers. Radial bulkheads 180 connect the corners of the center well 100 to the outer cylindrical shell and extend the full height of the cylinder. The longitudinal stiffeners 120 of the outer-shell, center well shell, and radial bulkhead shells are continuous and pass through the girders 140, and also the flats 160 that separate the cylinder into water tight compartments. Because the compartments must be water tight, any passages provided in the plates 160 to allow continuity of the longitudinal stiffeners 120 must be sealed after assembly. This requires a large amount of labor and also increases the risk of a leak due to the large number of areas that must be sealed by welding.

The radial bulkheads 180 create very stiff points of support for the girders 140 on the outer-shell. Under the dominant loading, which is hydrostatic, these supports inadvertently cause these girders to act as bending elements spanning between these supports and, in the case of circular cylinders, prevent them from acting far more efficiently as rings in compression. Since the girders 140 are acting in "beam action" instead of acting as compression rings, the capacity of the shell plate in circular cylinders to carry hydrostatic loadings is also greatly under utilized since only part of the plate is effective as the compression flange of the girders ("effective width").

The straight sides 200 of the center well 100 necessarily cause the girders 140 of the center well 100 to act as bending elements under the dominant hydrostatic loadings. The radial bulkheads 180 themselves only see hydrostatic loading in the circumstances where an adjacent compartment floods but, in such circumstances, the girders also act as bending elements spanning between the center well shell and outer-shell. All the girders for these shells and bulkheads must be located in the same horizontal plane so their end terminations can be tied together to provide structural continuity. Consequently, these end terminations have complex curved transitions where they join each other. These very labor-intensive transitions are required to mitigate "hot-spot" stresses at these highly loaded locations but they only reduce, not eliminate, the extent of these stresses. As a result, additional labor-intensive insert plates are normally included in the girder webs to reduce the remaining hot-spot stresses to values below stress allowables. "Tripping brackets" 220 (out-of-plane gusset-type lateral bracing for the girders) are added to brace the girders against torsional buckling.

The arrangement of the structural framing for cylindrical hulls in the prior art directly impacts the plan for the fabrication of sub assemblies and the erection of the full hull. In the prior art of Spar hulls, the cylindrical tanks are divided into sections (sub-assemblies), both in plan (with radial bulkheads) and longitudinally (with flats). These portions of the cylinder are pre-fabricated in jigs and then moved to the final assembly site where they are joined to make full circular sections. These sub-assemblies are normally constructed on their side primarily to use the weight of the section to conform the outer-shell to the curvature of the jig or form. These sub-assemblies are removed from the jigs in an advanced state of structural completion and rotated one hundred eighty degrees to complete the pre-outfitting on the outer-shell and then rotated again to be joined into the hull cylinder, which is assembled on its side. The cylindrical columns for Semis and TLPs are normally assembled vertically while the pontoon cylinders for Semi's and cylinders for Spars are normally assembled horizontally. Assembling cylinders when they are supported on one side by the fabrication supports requires the sub-assemblies to be very stiff to avoid unacceptable distortion of the lower section as the other sections above the lower section are added. While these sections are naturally very stiff when made as quadrants in the jigs and thus amenable to the loadings from horizontal assembly, this stiffness works against the need for flexibility to fit the sections together. The result is a contradiction in the stiffness requirements of erection handling versus fit-up that complicates the assembly process.

SUMMARY OF INVENTION

The present invention addresses the shortcomings in the known art by providing a more simplified structure and changing the load paths in the main structure to utilize load carrying capacity in the flats that was unused in the known art.

The invention provides an improved floating circular hull construction arrangement. The hull is divided into sections by watertight flats. In each section, longitudinal girders spaced radially around the inside of the outer shell terminate both before reaching the flats and at the flats and do not penetrate the flats. One end of the longitudinal girders is attached to radial girders that extend across the flats to the inner and outer shells and the other ends are attached to the flats directly in line with the radial girders. A panel stiffening arrangement on the inner circumference of the outer shell is attached to the outer shell and the longitudinal girders. Longitudinal girders spaced around the outer circumference of the inner shell extend along the length of the inner shell and are attached to the radial girders and the flat in the same manner as the longitudinal girders on the outer shell. The flats are stiffened with angles or bulb tees curved to form concentric circles that are in turn supported by the radial girders spaced around the flats and spanning between the inner and outer-shells. The compartments are assembled with the circular sections in a vertical orientation to minimize self-weight distortion during erection. The completed circular sections are rotated to the horizontal to be joined to the other sections to form a complete cylinder.

The various features of novelty which characterize the invention are pointed out with particularity in the claims annexed to and forming part of this disclosure. For a better understanding of the present invention, and the cost efficiencies attained by its use, reference is made to the accompanying drawings and descriptive matter, forming a part of this disclosure, in which a preferred embodiment of the invention is illustrated.

BRIEF DESCRIPTION OF THE DRAWINGS

In the accompanying drawings forming a part of this specification and in which reference numerals shown in the drawings designate like or corresponding parts throughout the same.

DETAILED DESCRIPTION OF THE PREFERRED EMBODIMENTS

Figure 1:
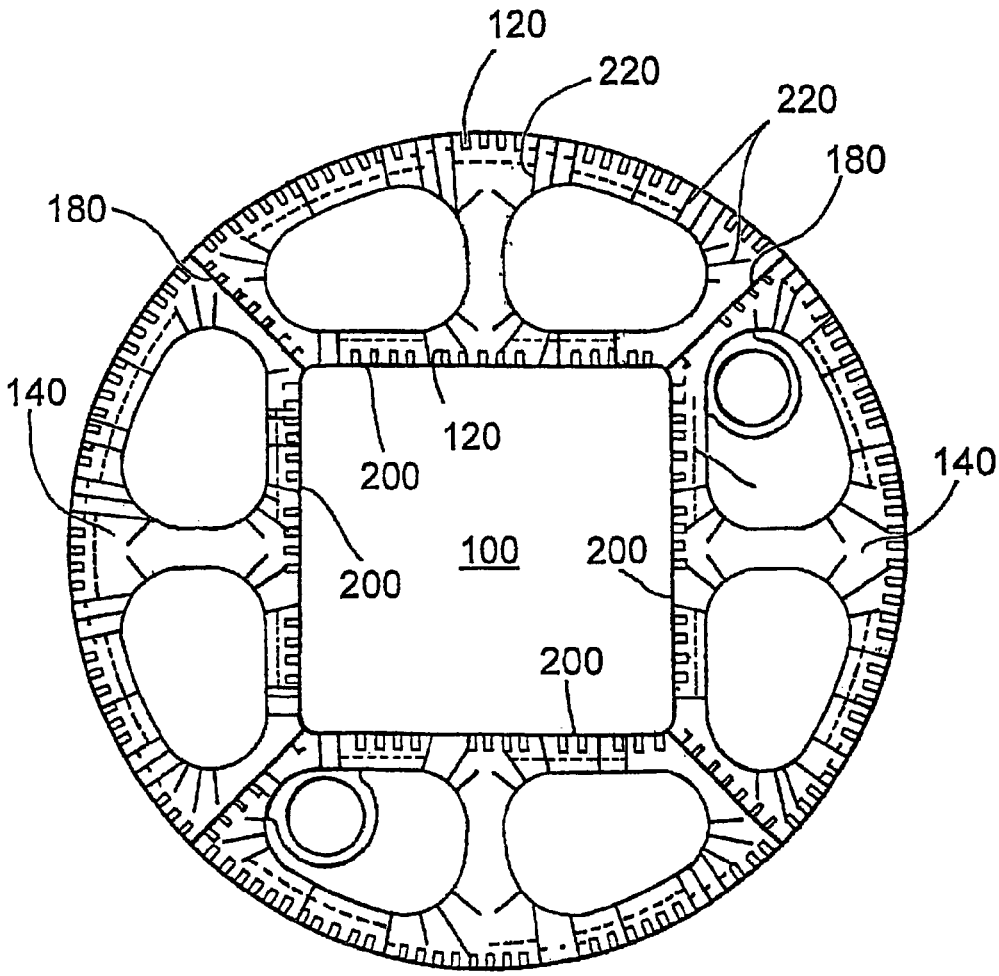
FIG. 1 PRIOR ART
FIGS. 1 and 2 illustrate cross section views of the prior art hull arrangement at different levels.
Figure 2:
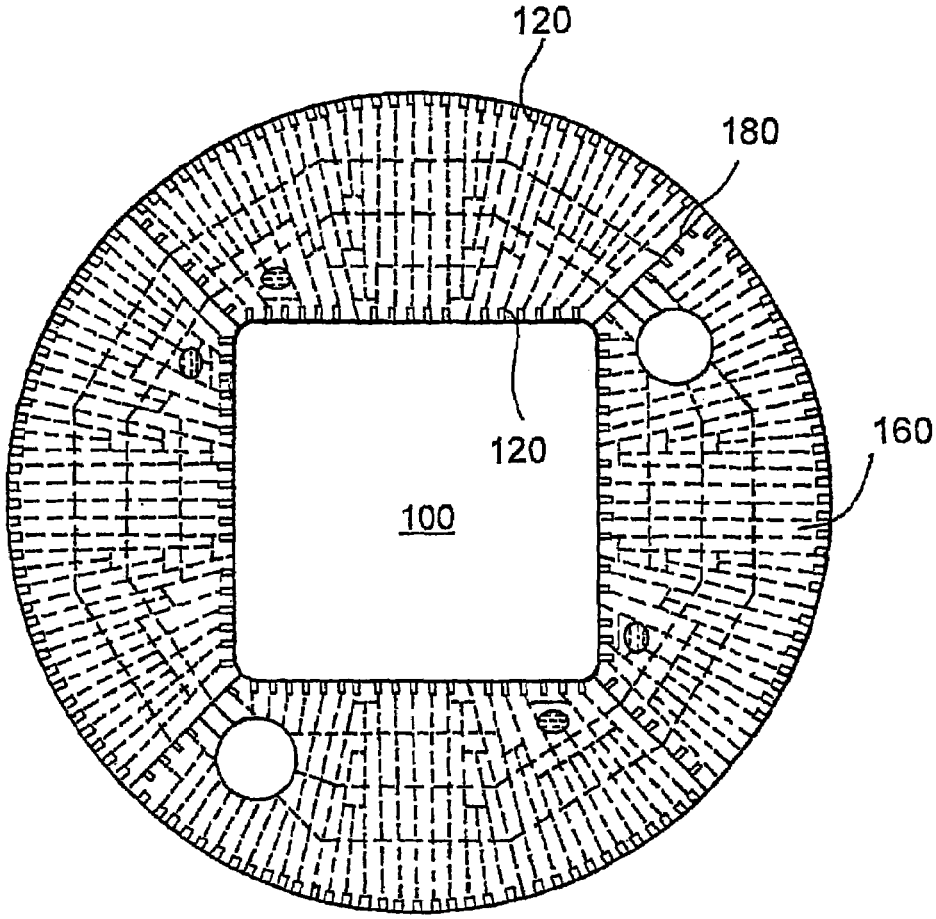
FIG. 2 PRIOR ART
Figure 3:
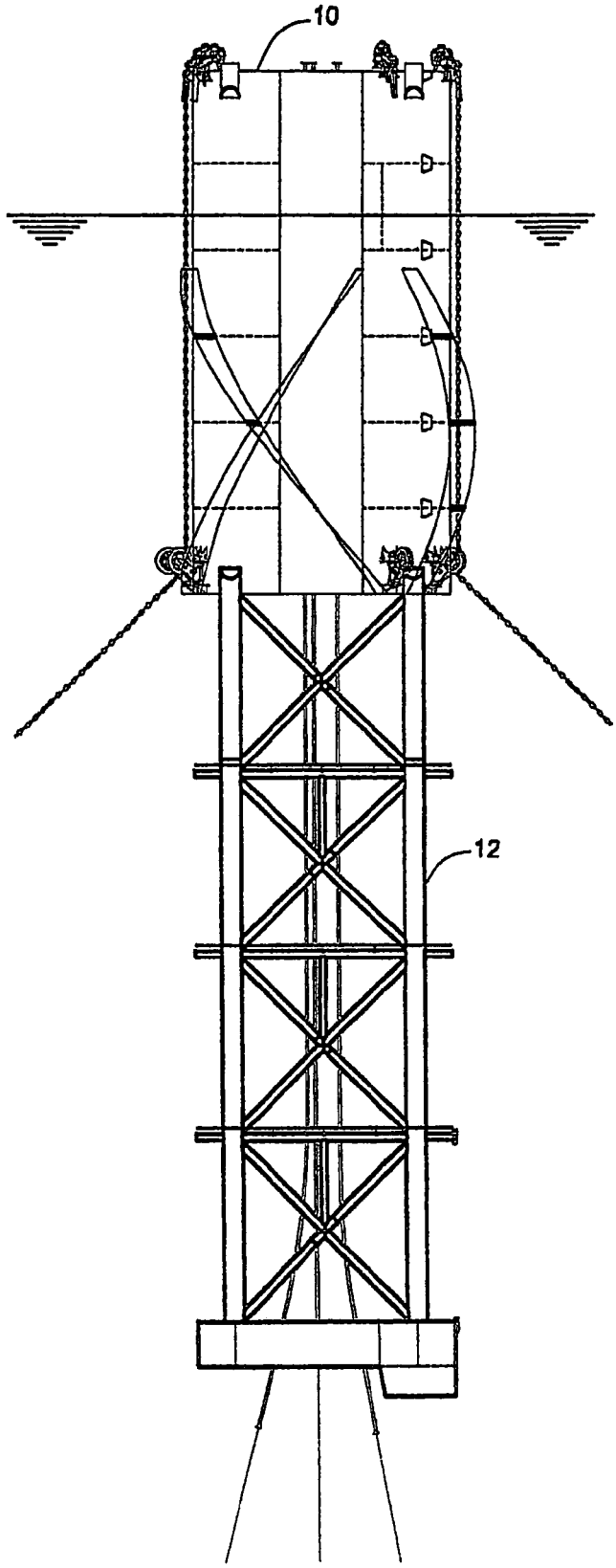
FIG. 3 illustrates a cylindrical hull according to the invention.
Figure 4:
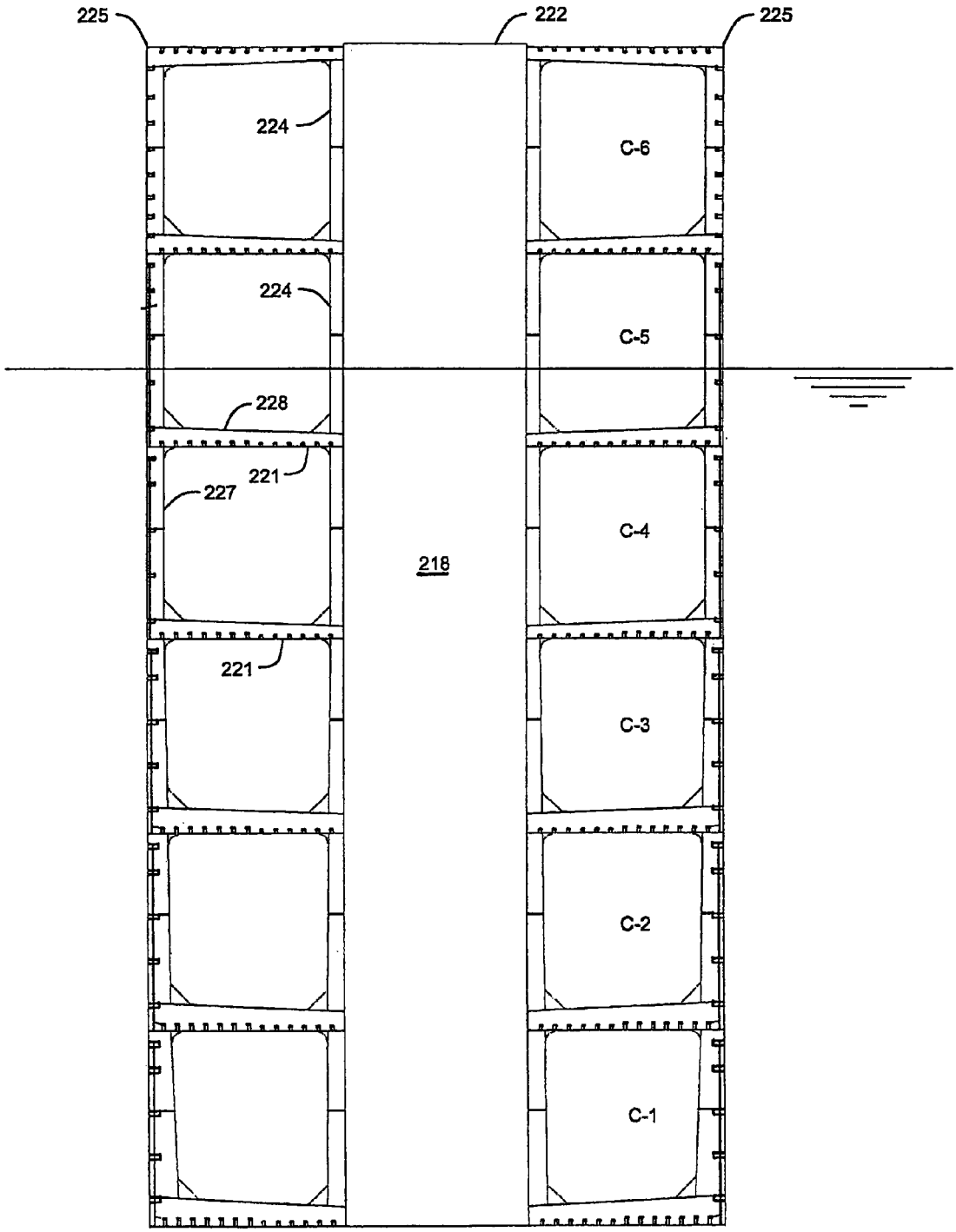
FIG. 4 illustrates the cylindrical section according to the invention.
Figure 5:
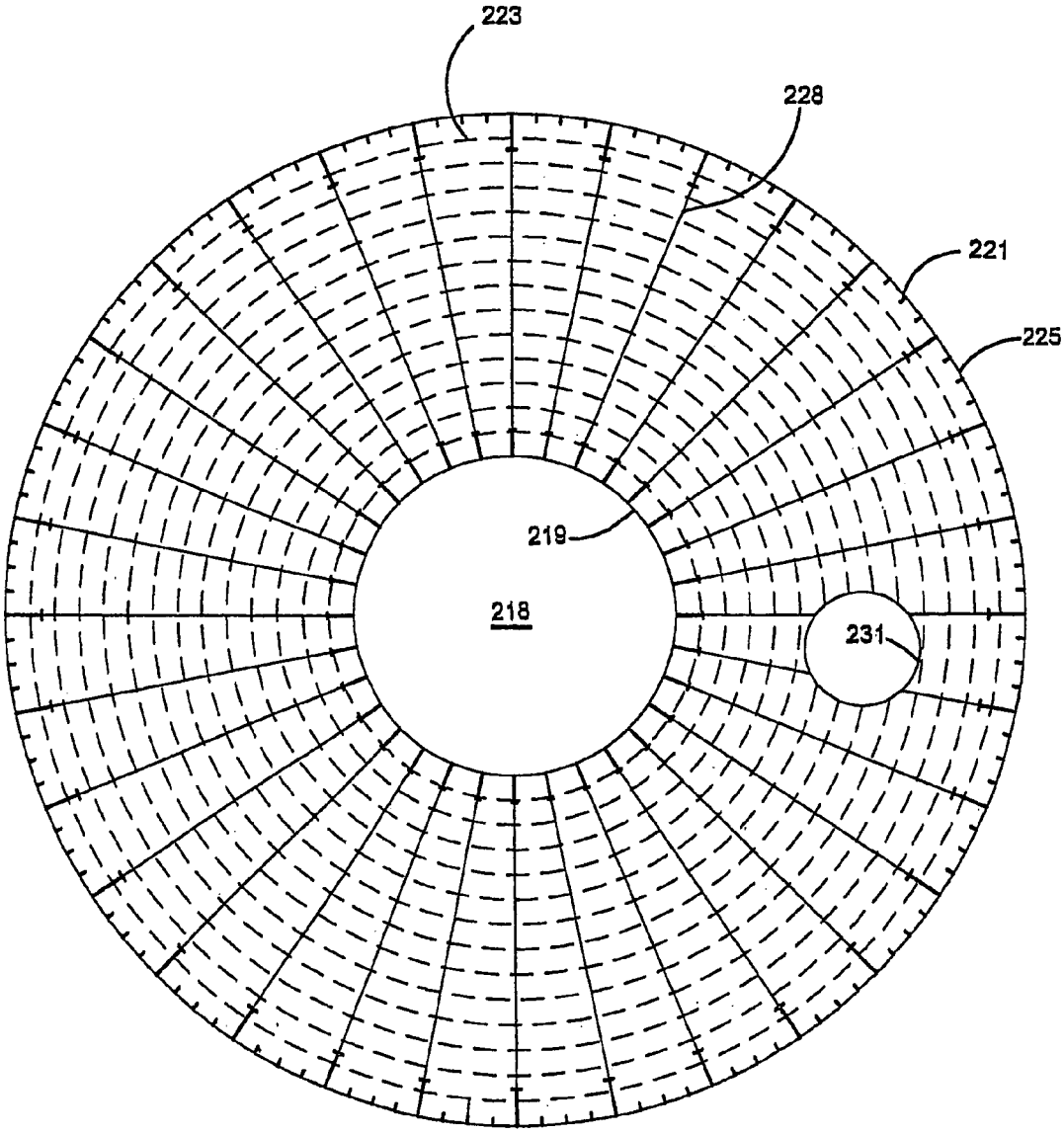
FIGS. 5 and 6 illustrate cross section views of the invention.
Figure 6:
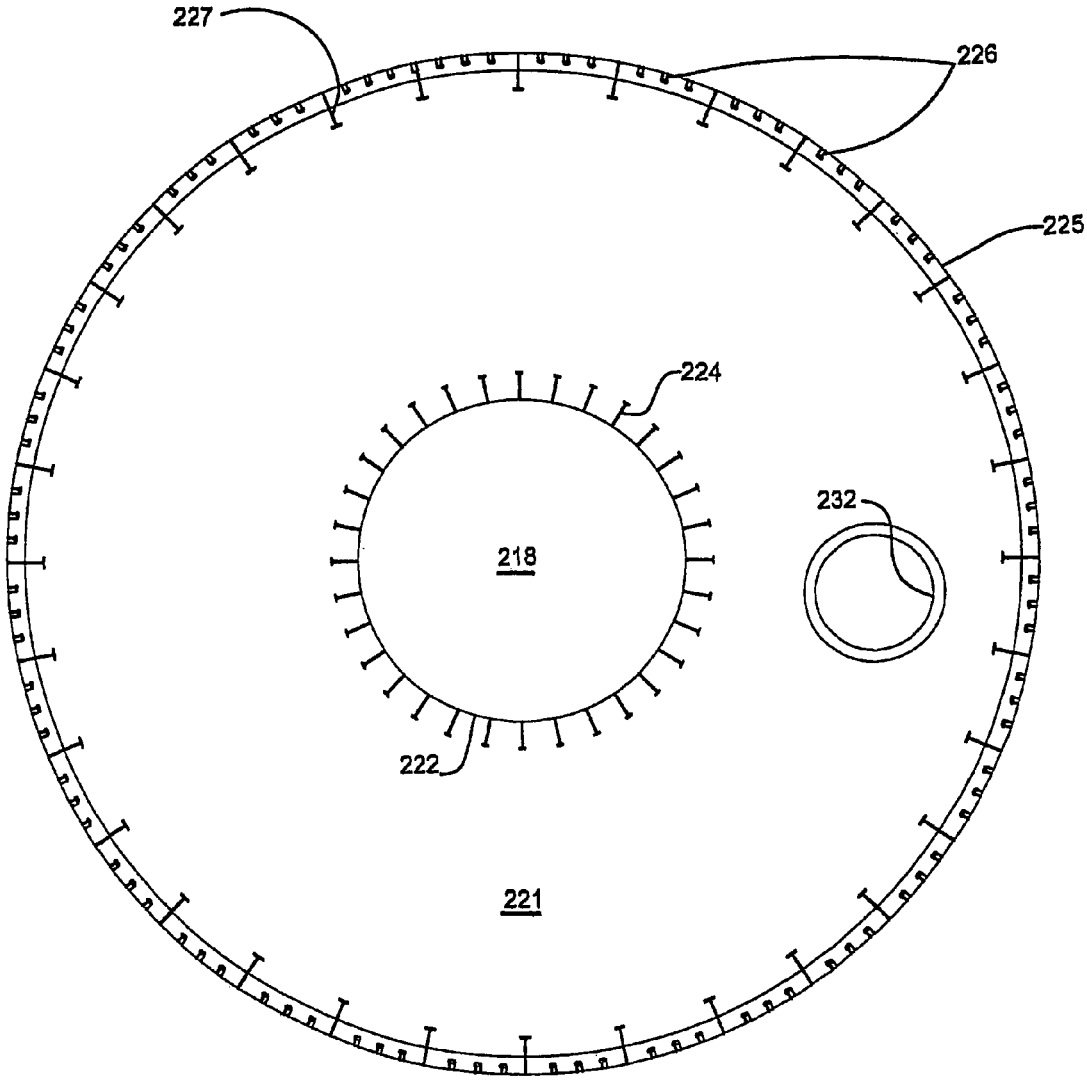
Figure 7:
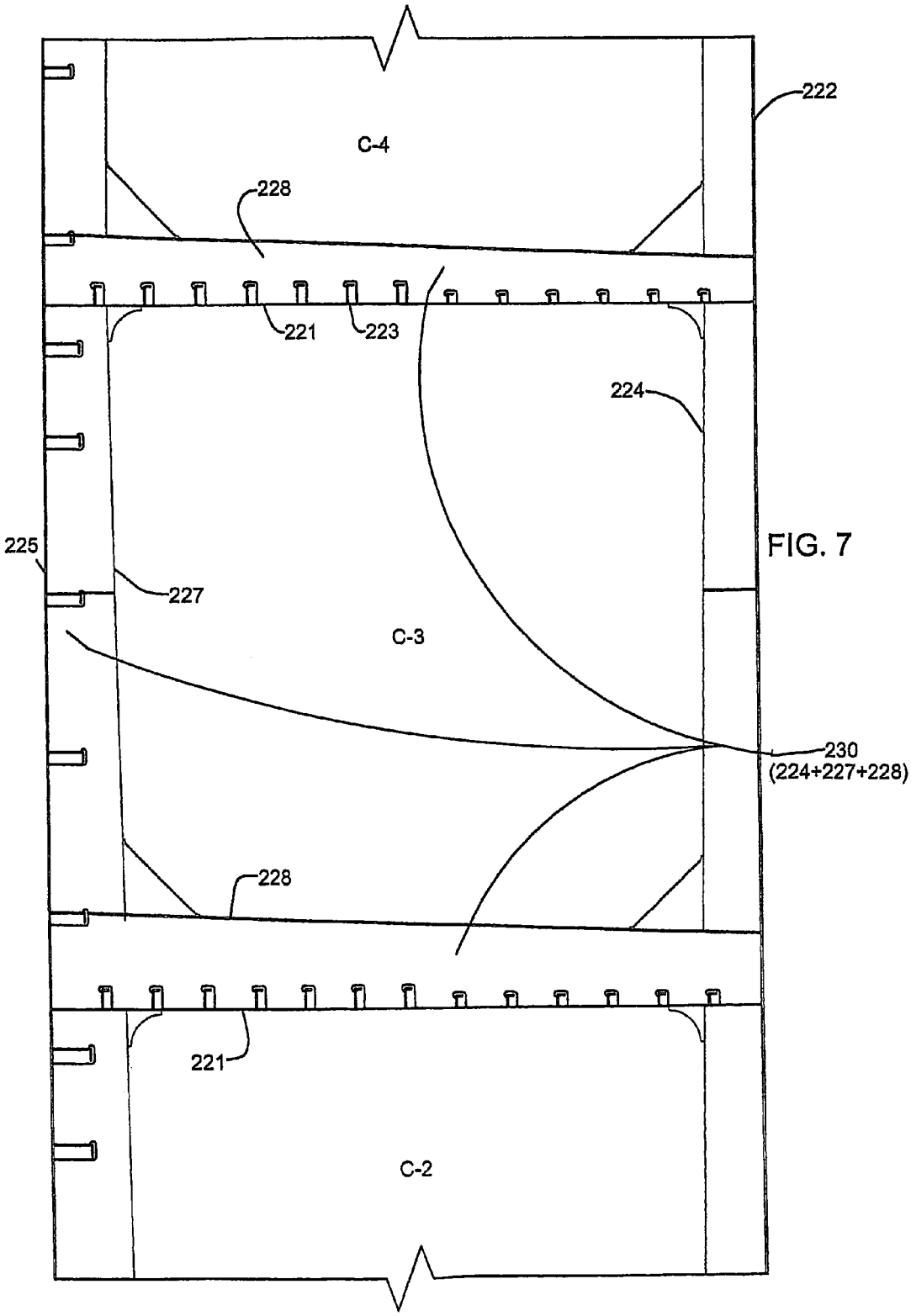
FIG. 7 illustrates a radial frame for one compartment comprised of longitudinal girders and radial girders.
Figure 8:
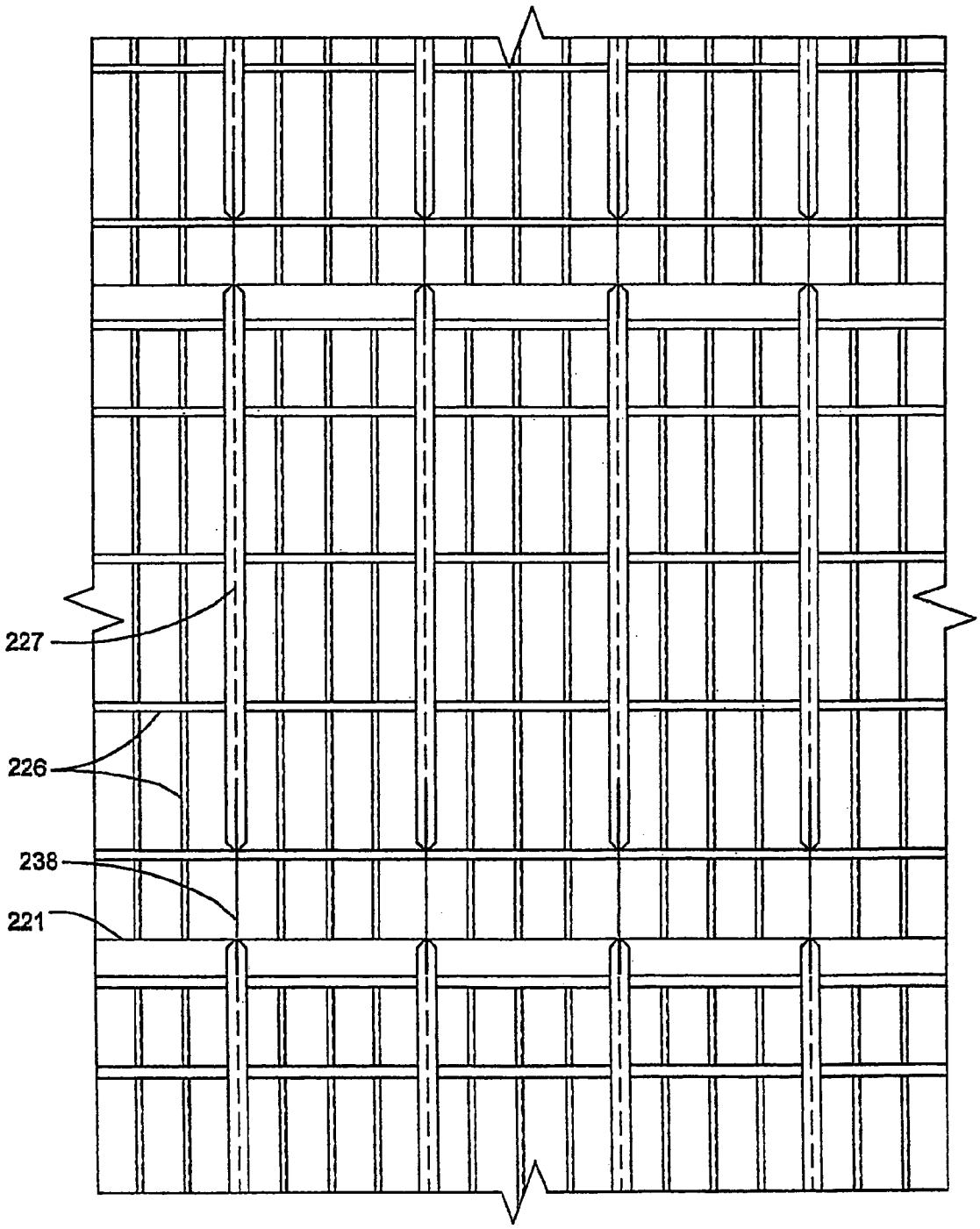
FIG. 8 illustrates a portion of the stiffening of the outer shell between two flats.
Figure 9:
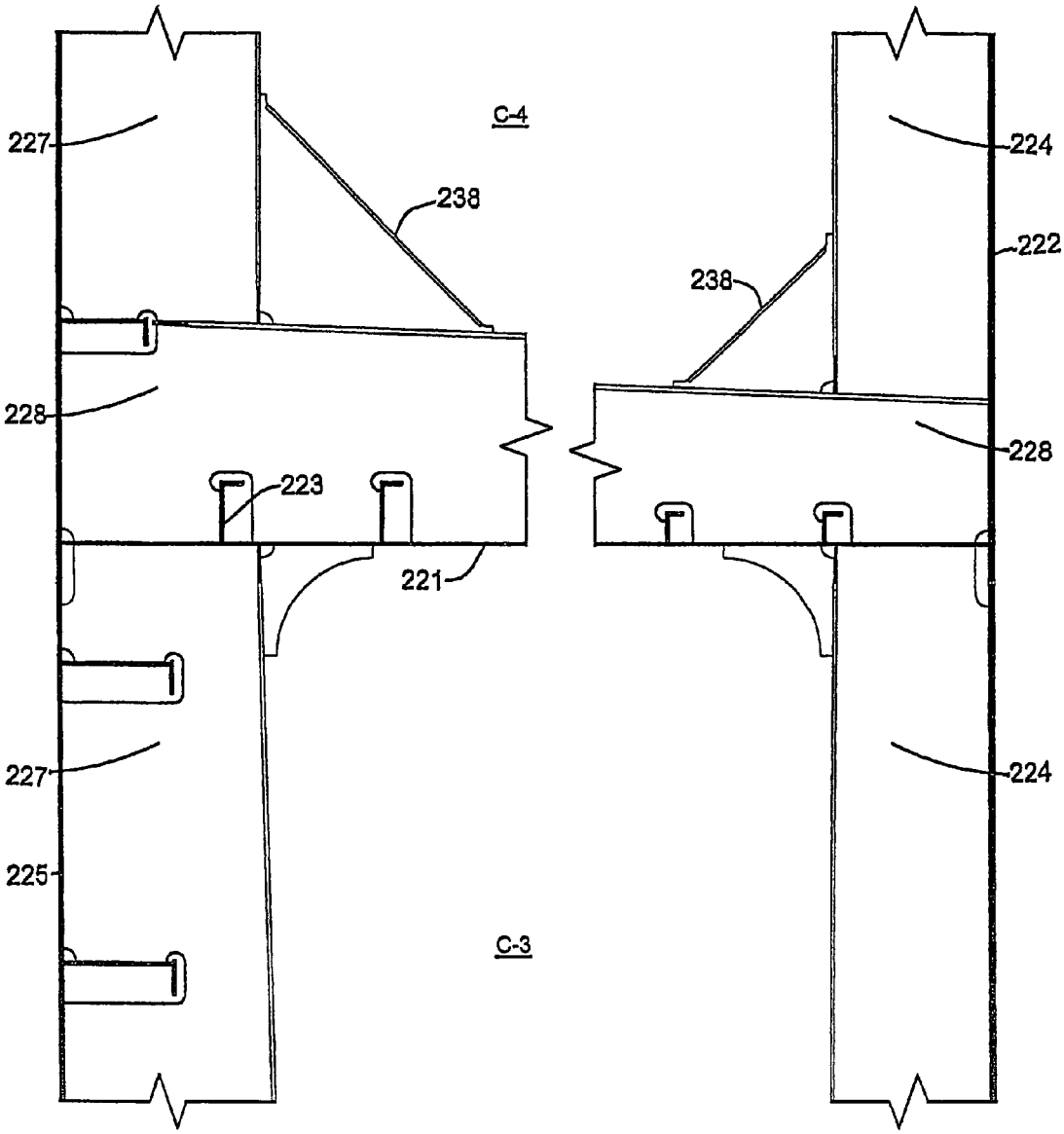
FIG. 9 illustrates the detailed connection of the longitudinal girders and the radial girders at both the outer shell and center well shell.
Figure 10A:
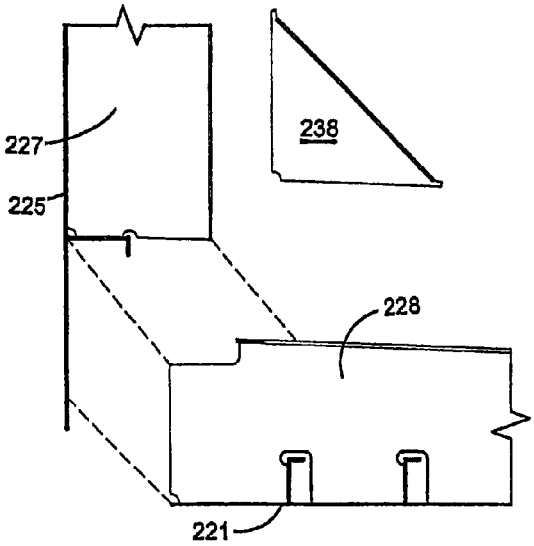
FIGS. 10A and B illustrate the assembly of the outer shell longitudinal girder with the flat of a compartment and the connection of one compartment to another.
Figure 10B:
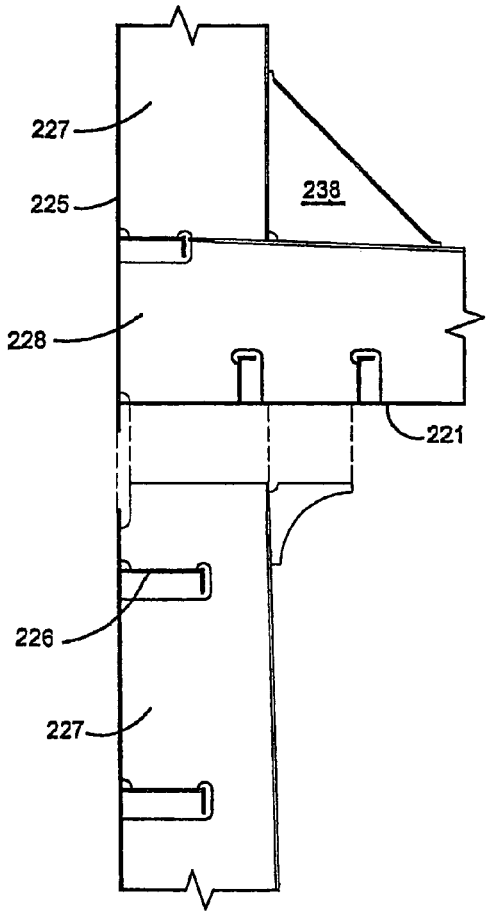

FIG. 3 is a side elevation view of a cylindrical hull 10 according to the invention that is used in conjunction with a lower open space frame or truss section 12. The combination of a buoyant upper hull with an open space frame is disclosed in U.S. Pat. No. 5,558,467. The exterior of hull 10 has the same appearance as buoyant hulls constructed according to the known art. The structural arrangement of the invention is illustrated in FIG. 4–11. Hull 10 is essentially formed from a plurality of cylindrical sections attached together end-to-end. Except for the size of some internal components that are dependent upon the water depth of each section, the internal construction of each section is essentially the same from an engineering standpoint. While a cylindrical buoyant hull may be formed from sections having different internal construction, it is preferable from a cost and efficiency consideration that all sections be formed using the same internal type of construction.

Taking the above construction option into account, the inventive concept is directed to having at least one section, and preferably all sections, of the hull 10 comprised of a flat circular plate 221 having a central circular cutout 219, stiffeners 223, radial girders 228, inner shell 222, inner shell longitudinal girders 224, outer shell 225, outer shell longitudinal girders 227, and secondary panel stiffening arrangement 226.

The flat circular plate 221 (FIGS. 5 and 6) is formed from multiple pieces of metal or cut to shape from a single large piece of metal. The flat circular plate 221 is positioned on supports that are suitable for construction of the hull section. The flat circular plate has a central circular cutout 219 and may also be provided with a second circular cutout 231 for use as an access shaft 232. The stiffeners 223 (FIG. 5, 7, 9, 11), which are preferably curved so as to be concentric with the plate 221, are positioned on the plate 221 and welded in place by any suitable means, such as manual or tracking-type semi-automatic welding units. This gives the advantage of all the stiffeners crossing all the radial girders in a perpendicular orientation, which makes for easier welding of the stiffeners to the radial girders. A further advantage of using curved stiffeners is the equalization of the spans of the flat plate between stiffeners and between the stiffeners and the inner and outer shells. It is preferable that the sections of stiffeners 223 be placed such that the joints necessary to form a continuous stiffener 223 do not radially overlap. Radial girders 228 (FIG. 4, 5, 7, 9–11), which are provided with open spaces to receive the stiffeners 223, are positioned on the plate 221 and welded to the plate 221 and stiffeners 223. The radial girders 228 are preferably provided with a flange rigidly attached to the edge of the girders for stiffening purposes. At a time determined by the fabricator a tubular access shaft 232 is positioned in cutout 231 and welded to both the flat plate 221 and the appropriate radial girders 228 to form a watertight seal between the shaft and flat plate and support the weight of the access shaft during service.

For ease of access, it is preferable that the inner shell 222 be formed and attached to the flat plate 221 before the outer shell 225 is completed.

The metal that will form the inner shell 222 is cut into sections the length of a portion of the circumference (typically $1/8^{th}$ to $1/3^{rd}$) and preferentially the height (width) of a mill plate. The portion of the height of the hull section and circumference will depend upon the fabricator. The metal piece is mechanically rolled to the circumference of the inner shell and laid on a jig form that matches the curvature of the inner shell. Additional metal pieces, if necessary, are placed on the jig form and welded together to form the height of one hull section. The inner shell longitudinal girders 224 are then positioned on the metal piece and welded in place. The remaining sections of the inner shell are formed in a similar manner.

One inner shell section is stood up with one of its ends adjacent to the flat plate 221 and the inner shell longitudinal girders 224 aligned with the radial girders 228, aligned and plumbed with the flat plate 221, and the shell section is welded to the flat plate to form a watertight seal. The inner shell longitudinal girders 224 are also welded to the radial girders 228. The remaining sections of the inner shell are positioned and welded in place in a similar manner to complete the inner shell. The sections that form the inner shell are spliced together by welding to form a watertight seal.

The metal plate that will form the outer shell 225 is cut into pieces that are connected together preferentially to form a plate the height of a full or partial hull section and a portion of the circumference (normally $1/8^{th}$ to $1/3^{rd}$). The outer shell longitudinal girders 227 may be positioned and welded in place while the metal plate is in the flat position. The longitudinal portions of the secondary panel stiffening arrangement 226 may also be positioned and welded in place at this time. The upper and lower edges of the metal plate are placed on a jig form that has the desired curvature of the outer shell. The weight of the plate forms the plate to the curvature of the outer shell on the jig with little or no additional force. The portions of the secondary panel stiffening arrangement 226 that follow the inside circumference of the outer shell (best seen in FIG. 8) are then positioned and welded in place.

Figure 11:
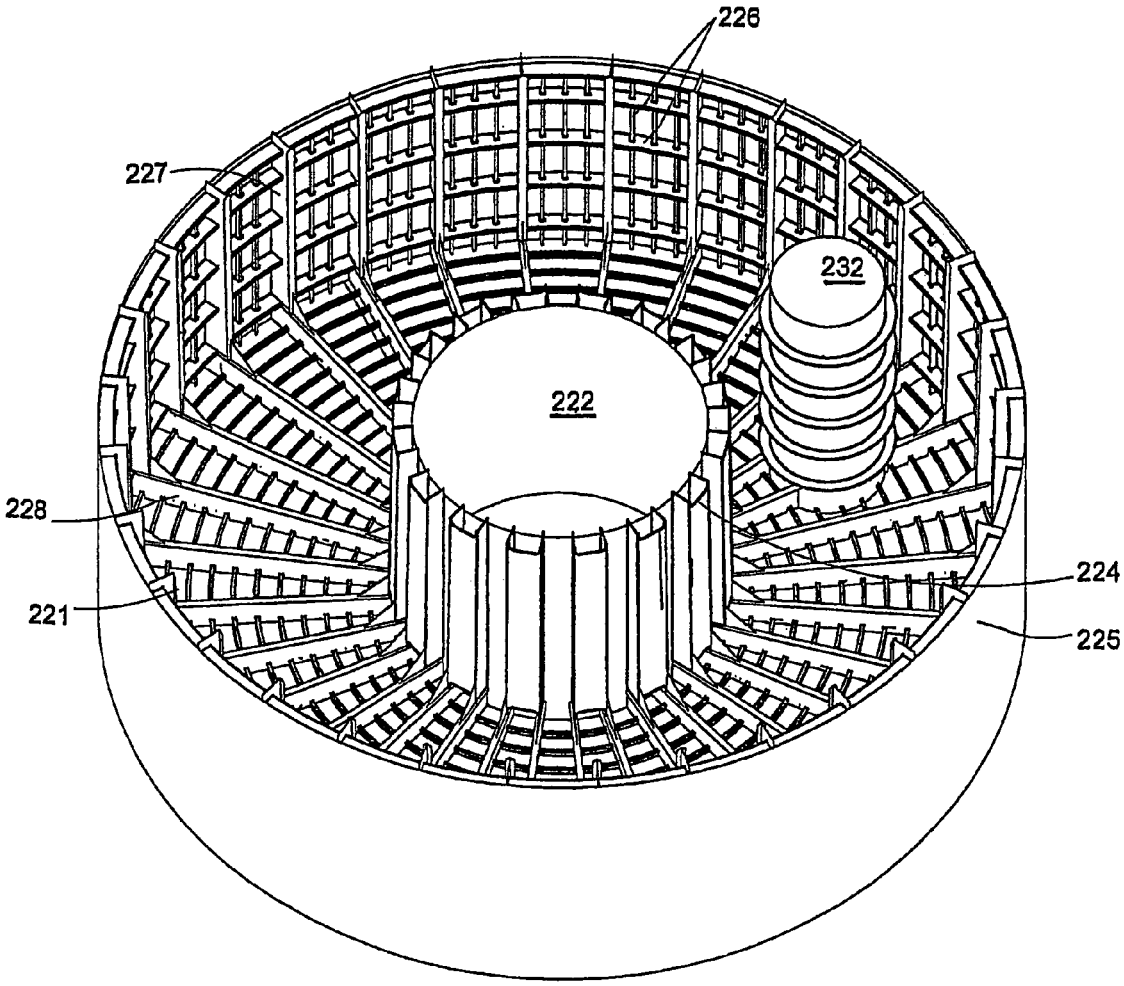
FIG. 11 illustrates a completed compartment with the full stiffening in place.

One portion of the outer shell is stood up in place with one of its ends adjacent the outer edge of the flat plate 221 and with the outer shell longitudinal girders 227 aligned with the radial girders 228. (FIGS. 10A and 10B) The metal plate is welded to the flat plate to form a watertight seal and the outer shell longitudinal girders 227 are welded to the radial girders 228. The remaining sections that form the outer shell are positioned and welded in place. The sections that form the outer shell are spliced together by welding to form a watertight seal. FIG. 11 illustrates a completed hull section.

Appurtenances such as outer hull strakes or internal access ladders are added at any time during the pre-fabrication and erection sequences as the fabricator considers desirable for the structure and when most efficient to the construction process.

To join one section of the hull to the next, a temporary erection brace assembly (not shown), similar to spokes on a bicycle wheel, is placed between the inner and outer shell at the opposite end from the flat plate. The constructed section is set on skidways and rotated so that the longitudinal axis of the hull section is in a horizontal position and placed adjacent to a previously constructed hull section that is also in a horizontal position. The end of the hull section with the flat is placed next to the end of the adjacent hull section where the temporary brace assembly is located. The two sections are moved together and then the outer shell, inner shell, and access shaft shell plates are welded together. The process is repeated to form the desired hull.

The invention provides a number of advantages.

Radial bulkheads are eliminated at all but the uppermost compartment by having the cylinder compartmented only with flats 221. Whether these compartment divisions are called flats or bulkheads depends upon the orientation of the cylinder in service. In this discussion, we are referring to divisions that are perpendicular to the axis of the cylinder, thus the elements that are "longitudinal" are parallel to the axis of the cylinder.

The shell plates of the inner and outer shells 222, 225 are stiffened using a structural arrangement in which the primary stiffening members are girders 224, 227 spanning longitudinally between the flats 221 which are located to subdivide the hull into compartments. These longitudinal girders 224, 227 perform the two main functions of delivering the load collected from the shell plate and its secondary panel stiffening arrangement 226 of angles and intermediate rings/girders directly to the flats 221 and directly augmenting the capacity of the shell plates to carry the global axial loads in each hull section.

This arrangement contrasts with a traditional stiffening arrangement for cylinders which uses rings and ring-frames, located in planes parallel to the flats/bulkheads, to collect the loads from the shell plate and secondary panel stiffening. In the ring-frame scheme, the external loads on the shell plate that are collected by the ring-frames are distributed across and around each ring-frame level, relatively independently from the loads on adjacent ring-frame levels or flats. In the prior art, a flat simply replaces a ring frame where a compartmentation division is required so the primary loading on the flat is from hydrostatics perpendicular to the surface of each flat.

In the longitudinal girder arrangement of this invention, the external loads on the shell plate are collected by the secondary panel stiffening 226 or directly from the shell plate, generally similar to the prior art but, instead of the girders 224, 227 acting independently of the flats 221, the external panel loads are delivered by the girders directly to the flats 221 at each end of these girders 224, 227. The loads at the ends of the girders 224, 227 are significant but the flats 221 inherently have a very large capacity for carrying loads in the plane of their stiffened plate, such as these loads from the girders 224, 227. By incorporating the cylindrical stiffened flats in the global structural scheme, the large reserve capacity of the flats 221 in the horizontal plane (unused in the prior art) is mobilized at little or no added cost while the capacity of the flats 221 to subdivide the hull into compartments and carry the associated hydrostatic design loadings is unaffected by the additional loads from the girders 224, 227.

In the scheme of this invention, each end of each longitudinal girder 224, 227 is aligned with a radial girder 228 on the flat 221 directly above or below the girder 224, 227. Through the simple attachments 238 shown in the drawings, the longitudinal girders 224, 227 combine with the radial girders 228 to form moment-resisting structural frames 230 that are oriented in a uniform radial pattern around each compartment.

The longitudinal secondary panel stiffeners (angles or bulb tees) 226 along the length of the outer-shell and located in between the longitudinal girders 224, 227, terminate at the face of a flat 221 or before the flat 221 in such a way that the stiffeners 226 are intentionally not structurally continuous across the flats 221. This eliminates the practice of either penetrating the flats with the stiffeners or adding brackets on each side of the flat to create structural continuity. Thus, the function of the stiffeners 226 is made specialized to act only to increase the buckling capacity of the outer-shell plate and not have the added function of contributing to the effective cross-sectional area of the cylinder 222 to carry axial and bending stresses. Augmentation of the shell plate axial and bending capacity is done by the longitudinal girders 224, 227 only. Having just one specialized function as a buckling stiffener greatly simplifies the fabrication of the stiffeners 226 by eliminating the need to align them and make them structurally continuous across each flat 221.

The open-bottomed (flooded) center well 218 is circular instead of rectangular and, without the radial bulkheads, its shell plate below the waterline is free to always act in tension from the hydrostatic loadings of the water contained inside. Using longitudinal girders 224, 227 on this shell completes the radial frames and insures the center well shell has significant extra buckling capacity.

Arranging the primary girders longitudinally has several advantages:

1) Makes use of the large "in-plane" capacity of the flats 221, that was unused in the prior art, to carry and balance the external hydrostatic loads on each hull section. This leads directly to more efficient use of steel material.

2) Allows the major girders-to be straight instead of curved or partially curved. These straight girders can have varying depths along their lengths to accommodate varying loadings such as the hydrostatic loading which changes with depth. Either constant depth or varying depth straight girders are far more cost effective to fabricate and brace out-of-plane than the curved girders in the prior art.

3) The straight girders are far easier to analyze and design.

4) The moment-resisting frames produced by aligning the longitudinal girders 224, 227 on the shells with the radial girders 228 on the flats 221 have several advantages compared to the prior art which did not have such frames.

a. The end fixity of the girders in a frame configuration gives them much greater capacity to carry bending loads for any given girder size, compared to "pin-ended" girders.
b. The longitudinal girders become structurally continuous without physically penetrating the flats. This continuity allows these girders to assist the shell plates in carrying global axial loads in the cylinder without the need to close up numerous penetration holes in the flats.

c. The stiffness of these radial frames at each compartment accumulates to carry a significant part of the axial shear in the cylinder that exists between the center well shell and the outer shell.

5) The direct nature of the load transfer of the reactions at the ends of the girders into the flats permits these connections to be made with simple fillet welds.

Compartments without radial bulkheads can all be accessed from a single access shaft 232.

The simplified shapes and connections of the girders and other stiffening elements virtually eliminate local "hot-spot stresses" in the structural system, thus eliminating "insert plates" in the shell stiffening rings, which were common in the prior art.

Terminating the angle/bulb tee stiffeners before the flat on the side where the shell splices occur improves flexibility of the shell plate for fit-up and alignment and improves the access to the inside of the shell plate for making and testing the weld.

What is claimed as invention is:

1. In a circular floating hull formed from a plurality of sections attached together end-to-end, at least one section of the hull comprising:

a. a flat circular plate having a central circular cutout;

b. a plurality of curved stiffeners attached to said flat circular plate;

c. a plurality of radial girders attached to said flat circular plate and said curved stiffeners;

d. an inner shell attached to the central circular cutout in said flat circular plate;

e. a plurality of longitudinal girders that extend along the length of the outer circumference of said inner shell and are spaced radially around the outer circumference of said inner shell;

f. an outer-shell attached to the outer circumference of said flat circular plate;

g. a plurality of longitudinal girders attached to the inner circumference of said outer-shell that stop at said flat circular plate and at said radial girders; and h. a secondary panel stiffening arrangement attached to the inner circumference of said outer shell and said longitudinal girders.

2. The hull section according to claim 1, wherein the attachment of said inner shell to said flat circular plate forms a watertight seal.

3. The hull section according to claim 1, wherein the attachment of said outer shell to said flat circular plate forms a watertight seal.

4. The hull section according to claim 1, wherein said longitudinal girders attached to said outer-shell are aligned with said radial girders on said flat circular plate.

5. The hull section according to claim 1, wherein said longitudinal girders attached to said outer-shell do not penetrate said flat circular plate.

6. The hull section according to claim 1, wherein said secondary panel stiffening arrangement comprises angle iron.

7. The hull section according to claim 1, wherein said secondary panel stiffening arrangement comprises bulb tees.

8. In a circular floating hull formed from a plurality of sections attached together end-to-end, at least one section of the hull comprising:

a. a flat circular plate having a central circular cutout;

b. a plurality of curved stiffeners attached to said flat circular plate;

c. a plurality of radial girders attached to said flat circular plate and said curved stiffeners;

d. an inner shell with one end attached to the central circular cutout in said flat circular plate and forming a watertight seal with said flat circular plate;

e. a plurality of longitudinal girders that extend along the length of the outer circumference of said inner shell and are spaced radially around the outer circumference of said inner shell;

f. an outer-shell with one end attached to the outer circumference of said flat circular plate and forming a watertight seal with said flat circular plate;

g. a plurality of longitudinal girders attached to the inner circumference of said outer-shell that stop at said flat circular plate and at said radial girders, aligning with said radial girders on both sides of said flat circular plate so as not to penetrate said flat circular plate; and h. a secondary panel stiffening arrangement attached to the inner circumference of said outer shell and said longitudinal girders.

9. The hull section according to claim 8, wherein said secondary panel stiffening arrangement comprises angle iron.

10. The hull section according to claim 8, wherein said secondary panel stiffening arrangement comprises bulb tees.

* * * * *